US007168955B2

(12) United States Patent
Umemura et al.

(10) Patent No.: US 7,168,955 B2
(45) Date of Patent: Jan. 30, 2007

(54) CONNECTION STRUCTURE OF CONNECTOR

(75) Inventors: Masakazu Umemura, Shizuoka-ken (JP); Tsutomu Sawada, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/006,531

(22) Filed: Dec. 8, 2004

(65) Prior Publication Data

US 2005/0124177 A1 Jun. 9, 2005

(30) Foreign Application Priority Data

Dec. 9, 2003 (JP) ..... P2003-410193

(51) Int. Cl.
*H01R 39/00* (2006.01)

(52) U.S. Cl. ..... 439/15; 439/164

(58) Field of Classification Search ..... 439/15, 439/164, 248

See application file for complete search history.

(56) References Cited

U.S. PATENT DOCUMENTS 5,238,420 A * 8/1993 Miyahara et al. ..... 439/164
5,246,377 A * 9/1993 Kawahara et al. ..... 439/164
6,042,405 A * 3/2000 Masuda et al. ..... 439/164
6,139,352 A * 10/2000 Daoud ..... 439/404
6,390,838 B1 * 5/2002 Kawamura ..... 439/164
6,736,645 B2 * 5/2004 Kato et al. ..... 439/15
6,843,672 B2 * 1/2005 Kato et al. ..... 439/164
6,860,745 B1 * 3/2005 Bolen et al. ..... 439/164
2005/0124177 A1 * 6/2005 Umemura et al. ..... 439/15
2005/0124193 A1 * 6/2005 Umemura et al. ..... 439/164

FOREIGN PATENT DOCUMENTS

JP 05-021108 1/1993

* cited by examiner

*Primary Examiner*—James R. Harvey
(74) *Attorney, Agent, or Firm*—Finnegan, Henderson, Farabow, Garrett & Dunner, L.L.P.

(57) ABSTRACT

A rock arm having repulsion is provided in a protruding condition in a rotary case in a spiral cable unit, and an engagement portion with which a hook of the rock arm engages is formed in a male connector. The male connector engages with the spiral cable unit by the engagement of the hook of the rock arm with the engagement portion, to prevent bending of the rock arm, in the state with the female connector fitted in a fitting hood portion.

4 Claims, 2 Drawing Sheets

CONNECTION STRUCTURE OF CONNECTOR

BACKGROUND OF THE INVENTION

1. Field of the Invention

Figure 1:
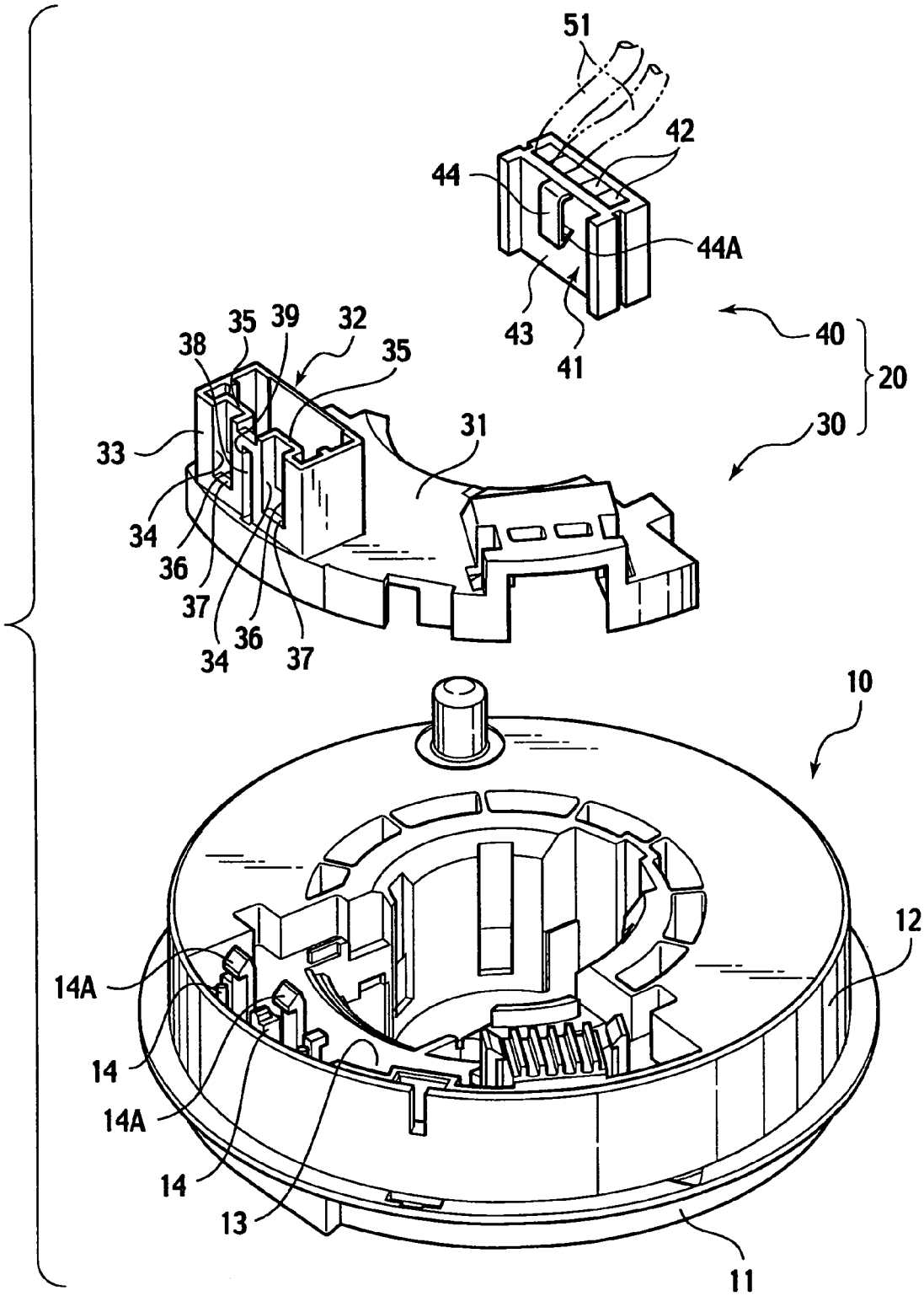

The present invention relates to a technique for connecting a connector to a spiral cable unit, and more specifically, relates to a structure in which a connector is connected to the spiral cable unit having a relative rotation structure.

2. Description of the Related Art

As a connection structure of a connector for electrically connecting relatively rotating members, for example, a structure for connecting a connector to a spiral cable unit put between a steering column and a steering wheel in a vehicle is known.

The spiral cable unit includes a fixed case (stator) and a rotary case (rotator) assembled so as to be able to rotate relative to the fixed case. A flat cable having flexibility is stored in a cable storing space formed by these cases in a spirally wrapped state. Rotation of the rotary case is allowed with respect to the fixed case in the spiral cable unit by tightening and loosening of the flat cable. The flat cable is connected to external equipment and the like of the spiral cable unit via a wire harness.

Conventionally, connection structures for connecting the spiral cable unit with the external equipment include one in which a female connector is fitted to a male connector screwed to the rotary case in the spiral cable unit. The female connector is connected to an end of an external harness connected to the external equipment, and inserted into a fitting hood portion formed in the male connector.

As another conventional art, there is known a technique in which a male connector is integrally formed with a fixed case of a spiral cable unit, a female connector on the external equipment side is fitted to the male connector, and a joint between the male connector and the female connector is fixed by a fixing member (cover) so as to prevent the female connector from being disengaged from the male connector which is disclosed in a Patent brochure, Japanese Patent Application Laid-open No. Hei-5-21108 (Page 2 and FIG. 3).

In the connection structure in which the male connector is screwed to the rotary case, or in the connection structure in which the male connector is integrally formed with the rotary case, however, there is a problem in that much man-hour and cost are required.

Further, even when the male connector is integrally formed with the rotary case, it is necessary to use a fixing member (cover) separately, and hence, the number of parts cannot be reduced.

SUMMARY OF THE INVENTION

The present invention has been achieved with such points in mind.

It is therefore an object of the present invention to provide a connection structure of a connector that can prevent a male connector from being disengaged from a spiral case unit, and increase the reliability of connection.

It is another object of the present invention to provide a connection structure of a connector that can realize reliable connection at a low cost, without requiring a fixing member such as a screw separately.

A first aspect of the present invention relates to the connection structure of a connector for connecting an external harness to a spiral cable unit in which a spiral cable is stored. This connection structure is structured such that the connector comprises a male connector connected to an end of the spiral cable and a female connector connected to an end of the external harness, the male connector is fixed to the spiral cable unit by a rock arm provided in the spiral cable unit and having repulsion against bending, and the female connector abuts against the rock arm to prevent bending of the rock arm, in the state with the male connecter fitted to the female connector.

A second aspect of the present invention, as it depends from the first aspect, relates to the connection structure of a connector according to the first aspect. This connection structure is structured such that the male connector comprises a fitting hood portion to which the female connector is fitted, and an engagement portion engaged with a hook formed in the rock arm, and the rock arm is exposed in the fitting hood portion, in the state with the rock arm engaging with the engagement portion.

A third aspect of the present invention, as it depends from the first or the second aspect, relates to the connection structure of a connector according to the first or the second aspect. This connection structure is structured such that the female connector comprises a latch piece latched by the male connector.

According to the present invention, the male connector is prevented from being disengaged from the spiral cable unit, thereby improving reliability of the connection thereof.

Furthermore, according to the present invention, another fixing member such as a screw is not required separately, thereby realizing a reliable connection structure at a low cost.

BRIEF DESCRIPTION OF THE ACCOMPANYING DRAWING

Figure 2:
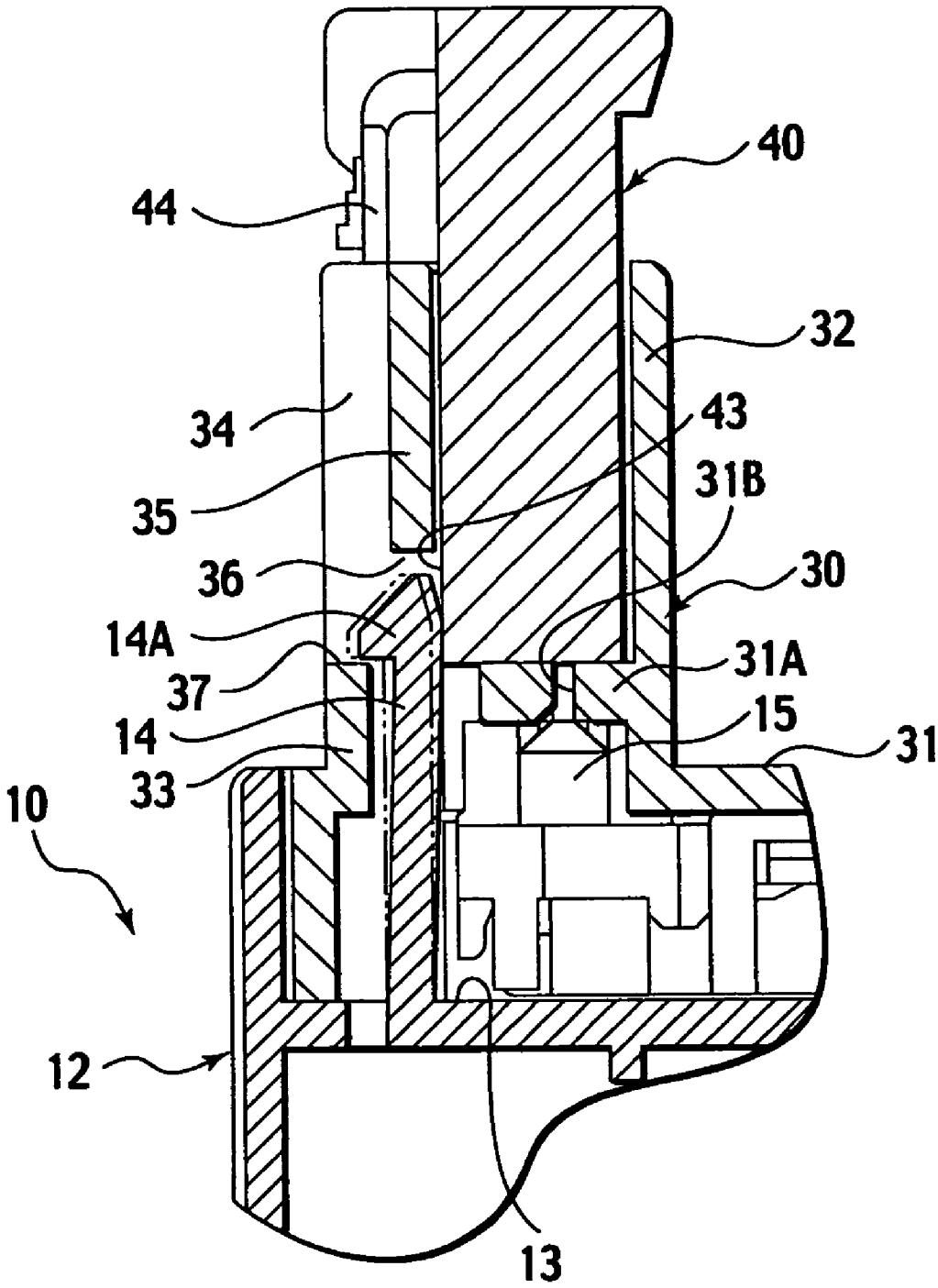

FIG. 1 is an exploded perspective view of a connection structure of a connector according to an embodiment of the present invention; and FIG. 2 is a cross section of the main part of the connection structure of the connector according to the embodiment of the present invention.

DETAILED DESCRIPTION OF THE PREFERRED EMBODIMENTS

Exemplary embodiments of the present invention will be explained below with reference to the accompanying drawings.

The connection structure of a connector according to the embodiment is applied to a portion where an external harness is connected to a substantially cylindrical spiral cable unit in which a spiral cable is stored. The spiral cable unit includes a fixed case (stator) and a rotary case (rotator) assembled so as to be able to rotate relative to the fixed case.

A flexible flat cable is stored in an inside cable storing space formed by these rotary and fixed cases in a spirally wrapped state. Rotation of the rotary case is allowed with respect to the fixed case in the spiral cable unit by tightening and loosening of the flat cable. The flat cable is connected to external equipment (for example, an airbag apparatus) of the spiral cable unit via a wire harness.

In the connection structure of the connector according to the embodiment, the connector is formed of a male connector coupled to an end of the spiral cable and a female connector coupled to an end of the external harness connected to the external equipment such as the airbag apparatus. The male connector has a fitting hood portion to which the female connector connected to the external harness is inserted.

A rock arm having flexibility and repulsion with respect to bending and having a hook for engagement formed thereon is provided in a protruding condition on the rotary case in the spiral cable unit. An engagement portion with which the hook of the rock arm is engaged is formed in the male connector. Therefore, the male connector is connected to the spiral cable unit by engaging the hook of the rock arm with the engagement portion.

Further, in the embodiment, the rock arm is exposed in the fitting hood portion of the male connector with the rock arm engaging with the engagement portion. Therefore, the female connector abuts against the rock arm to block bending of the rock arm, in the state with the female connector fitted to the fitting hood portion of the male connector.

The connection structure of the connector according to the embodiment of the present invention will be explained with reference to the drawings. This embodiment is applied to a case in which the connection structure of the connector according to the present invention is provided in a vehicle steering device. In the embodiment, explanations of the configuration of the steering device are omitted. As shown in FIG. 1, the connection structure of the connector according to the embodiment is for connecting a connector 20 to a spiral cable unit 1. The connector 20 is formed of a male connector 30 and a female connector 40.

(Spiral Cable Unit)

In the spiral cable unit 10, a fixed case (stator) 11 in a shape of a cylindrical container, fixed on a steering column (not shown) side and a rotary case (rotator) 12 provided so as to be fitted to the fixed case 11 and be able to rotate relative to the fixed case 11 are assembled, and a flat cable (not shown) is stored in a spirally wrapped state in a cable storing space (not shown) formed by the fixed case 11 and the rotary case 12. The flat cable is wrapped around spirally so as to be able to tighten and loosen, so that the rotation of the rotary case 12 with respect to the fixed case 11 is allowed.

A male connector-mounting recessed portion 13 in which the male connector 30 is mounted is formed on the upper surface of the rotary case 12. In the embodiment, a pair of rock arms 14 having flexibility and repulsion with respect to bending is formed on the bottom of the male connector-mounting recessed portion 13, so as to protrude by a predetermined size upward from the upper surface of the rotary case 12. A hook 14A protruding toward the outside of the rotary case 12 is formed on the upper edge of the rock arm 14. As shown in FIG. 2, the hook 14A engages with an engagement portion 37 of the male connector 30, to fix the male connector 30 in the rotary case 12. A plurality of male terminals 15 accommodated in the male connector 30 when the male connector 30 is mounted is arranged in the inner vicinity of the rock arm 14 on the bottom of the male connector-mounting recessed portion 13 in the rotary case 12. The male terminal 15 is connected to respective ends of leads of the flat cable (not shown) stored in the cable storing space in the spiral cable unit 10.

(Male Connector)

The male connector is formed so as to be fitted to the male connector-mounting recessed portion 13 of the rotary case 12. More specifically, the male connector 30 includes a male connector body 31 formed in a planar shape same as that of the male connector-mounting recessed portion 13 and in a reversed shape of a container, a fitting hood portion 32 formed so as to open upward above the male connector body 31. A terminal insertion hole 31B is provided in an open condition so that the male terminal 15 can protrude upward, in an inner bottom 31A of the fitting hood portion 32. Therefore, when the male connector 30 is mounted on the rotary case 12, the male terminal 15 is inserted into the terminal insertion hole 31B and protruded upward from the inner bottom 31A of the fitting hood portion 32.

A recessed portion 34 is formed so as to be recessed inward of the fitting hood portion 32 at positions respectively corresponding to the pair of rock arms 14A arranged in a standing condition in the rotary case 12, on an outside side wall 33 of the fitting hood portion 32 in the male connector 30. The lower part of a bottom wall 35 (parallel to the side wall 33) of the recessed portion 34 is an opening 36 formed by making a notch. By forming the opening 36, the upper edge of the rock arm 14 does not interfere insertion of the male connector 30 into the male connector-mounting recessed portion 13. When the rock arm 14 is inserted, the rock arm 14 is exposed in the fitting hood portion 32 by the opening 36. The edge of the side wall 33 facing the lower part of the opening 36 becomes the engagement portion 37 with which the hook 14A of the rock arm 14 engages.

A rectangular opening 38 is formed in the central part (a portion put between the pair of bottom walls 35) of the side wall 33 in the male connector 30, from the lower part to the middle part thereof. The upper edge of the opening 38 becomes a latch 39 with which a latching protrusion 44A of a latch piece 44 of the male connector 40 (described later) is latched.

(Female Connector)

In the female connector 40, a plurality of vertically penetrating female terminal insertion holes 42 is formed in a substantially rectangular female connector body 41 fitted to the fitting hood portion 32 of the male connector 30. A female terminal (not shown) connected to the end of an external harness 51 connected to the air bag apparatus (not shown) is fitted and secured in the female terminal insertion hole 42. The latch piece 44 is formed so as to hang down, on the upper part of the side wall 43 facing outward of the rotary case 12, when fitted to the fitting hood portion 32 of the male connector 30. The latch protrusion 44A provided in a protruding condition toward the side wall 43 is formed on the inner side of a free end of the latch piece 44. The latch protrusion 44A is latched by the latch 39 in the fitting hood portion 32 when the female connector 40 is fitted to the fitting hood portion 32 of the male connector 30, to prevent the female connector 40 from coming out from the fitting hood portion 32.

(Action and Connection Method of the Connection Structure in the Embodiment)

The action and the connection method in the connection structure of the connector in the embodiment will be explained. The male connector 30 is assembled to the male connector-mounting recessed portion 13 formed in the rotary case 12 in the spiral cable unit 10. At this time, the rock arm 14 provided in a protruding condition in the rotary case 12 is inserted into the fitting hood portion 32 of the male connector 30. As a result, as shown in FIG. 2, the hook 14A of the rock arm 14 abuts against the lower edge of the side wall 33 of the fitting hood portion 32 and is bent inward. Further, since the male connector 30 is inserted into the male connector-mounting recessed portion 13, the rock arm 14 repulses against it, and hence, the hook 14A engages with the engagement portion 37 formed on the side wall 33 of the male connector 30. At this time, the inside surface of the rock arm 14 inside of the rotary case 12 is exposed in the fitting hood portion 32, and becomes substantially flush with the inner surface of the fitting hood portion 32. An end of the male terminal 15 is inserted from the terminal insertion hole 31B formed in the inner bottom 31A of the fitting hood portion 32 and protrudes toward inside of the fitting hood portion 32. In this state, the male connector 30 cannot be disengaged from the rotary case 12 due to the engagement with the hook 14A of the rock arm 14. However, the male connector 30 can be disengaged from the rotary case 12 by bending the rock arm 14 inward again and disengaging the hook 14A from the engagement portion 37.

When the female connector 40 is inserted into the fitting hood portion 32 of the male connector 30, the latch piece 44 comes down along the side wall 33 of the fitting hood portion 32, and the latch protrusion 44A is latched by the latch 39 formed on the side wall 33, thereby preventing the female connector 40 from being disengaged from the male connector 30. At this time, the female terminal (not shown) arranged in the female terminal insertion hole 42 of the female connector 40 is coupled with the end of the male terminal 15 protruding into the fitting hood portion 32 and becomes electrically conductive. As shown in FIG. 2, when the female connector 40 is connected to the fitting hood portion 32, the side wall 43 of the female connector 40 is positioned at a position proximate to the side of the rock arm 14 exposed in the fitting hood portion 32. Therefore, the bending of the rock arm 14 is blocked by the side wall 43 of the female connector 40 and the hook 14A is not released from the engagement portion 37 of the male connector 30. Accordingly, the male connector is reliably fixed in the rotary case 12.

In the connection structure of the connector according to the embodiment, it can be prevented that the male connector 30 is disengaged from the spiral cable unit 10, thereby enabling reliable connection thereof to the air bag apparatus.

Further, according to the embodiment, a fixing member such as a screw is not required separately at the time of fixing the male connector 30 in the rotary case 12, and hence, a reliable connection structure can be realized at a low cost.

Other Embodiments

One embodiments of the present invention has been explained above, but the present invention is not limited thereto, and various changes are possible within the scope of the present invention.

For example, in the above embodiment, the number of rock arms 14 is two, but the number may be one or three or more.

The present invention can be used in the automobile industry, and manufacturing field of vehicle electrical equipment and the like.

The entire contents of Japanese Patent Application, No. P2003-410193 (filed Dec. 9, 2003) are incorporated herein by reference.

What is claimed is:

1. A connection structure of a connector for connecting an external harness to a spiral cable unit in which a spiral cable is stored, wherein the connector comprises a male connector connected to an end of the spiral cable and a female connector connected to an end of the external harness;

the male connector is fixed to the spiral cable unit by a rock arm provided in the spiral cable unit and having repulsion against bending; and the female connector abuts against the rock arm to prevent bending of the rock arm, in the state with the male connector fitted to the female connector.

2. The connection structure of a connector according to claim 1, wherein the male connector comprises a fitting hood portion to which the female connector is fitted, and an engagement portion engaged with a hook formed in the rock arm; and the rock arm is exposed in the fitting hood portion, in the state with the rock arm engaging with the engagement portion.

3. The connection structure of a connector according to claim 1, wherein the female connector comprises a latch piece latched by the male connector.

4. The connection structure of a connector according to claim 2, wherein the female connector comprises a latch piece latched by the male connector.

* * * * *